US011306507B2

(12) United States Patent
Bowley

(10) Patent No.: US 11,306,507 B2
(45) Date of Patent: Apr. 19, 2022

(54) HIGH SECURITY LOCKING SYSTEM WHICH FORMS A DEVIATING PICKING PATH AND ASSOCIATED DEVIATED KEY

(71) Applicant: Bowley Lock Company Inc., Calgary (CA)

(72) Inventor: Ryan Thomas Bowley, Calgary (CA)

( * ) Notice: Subject to any disclaimer, the term of this patent is extended or adjusted under 35 U.S.C. 154(b) by 246 days.

(21) Appl. No.: 16/596,849

(22) Filed: Oct. 9, 2019

(65) Prior Publication Data

US 2020/0123807 A1 Apr. 23, 2020

Related U.S. Application Data

(60) Provisional application No. 62/746,643, filed on Oct. 17, 2018.

(51) Int. Cl.

| | |
|---|---|
| ***E05B 27/00*** | (2006.01) |
| ***E05B 19/14*** | (2006.01) |
| ***E05B 19/00*** | (2006.01) |

(52) U.S. Cl.

CPC ..... *E05B 27/0057* (2013.01); *E05B 19/0017* (2013.01); *E05B 19/0041* (2013.01); *E05B 19/14* (2013.01); *E05B 27/001* (2013.01); *E05B 27/0007* (2013.01); *E05B 27/0082* (2013.01)

(58) Field of Classification Search

CPC .. E05B 19/0017; E05B 19/0041; E05B 19/14; E05B 27/001; E05B 27/0017; E05B 27/0057; E05B 27/006; E05B 27/0007; E05B 27/0082; E05B 29/00

See application file for complete search history.

(56) References Cited

U.S. PATENT DOCUMENTS

| | | | | |
|---|---|---|---|---|
| 2,552,012 A * | 5/1951 | O'Kane | E05B 19/00 | 70/419 |
| 2,682,764 A * | 7/1954 | Kotab | E05B 19/00 | 70/419 |
| 4,094,175 A * | 6/1978 | Pechner | E05B 27/005 | 70/383 |
| 5,893,285 A * | 4/1999 | Athanassiou | E05B 27/00 | 70/493 |
| 6,079,239 A * | 6/2000 | Hsiao | E05B 29/00 | 70/358 |
| 6,698,264 B1 * | 3/2004 | Liao | E05B 27/001 | 70/375 |
| 7,174,757 B1 * | 2/2007 | Tseng | E05B 15/08 | 70/358 |

(Continued)

*Primary Examiner* — Christopher J Boswell

(74) *Attorney, Agent, or Firm* — Ryan W. Dupuis; Kyle R. Satterthwaite; Ade & Company Inc.

(57) ABSTRACT

A locking system has a lock housing having first pin slots, a lock cylinder having second pin slots and being supported within the lock housing such that rotation of the lock cylinder is dependent upon a position of tumbler pins within the pin slots, and an idler block defining a keyway to receive a deviated key in which the idler block is rotatable relative to the lock cylinder between an entry position and a pin position aligning the key with the pin slots. One or more translating shields in the idler block are movable from an open position in which the keyway is unobstructed by the shield to allow for insertion or removal of the deviated key and a closed position in which the translating shield protrudes at least partway into a path of the keyway without interfering with rotation of the deviated key with the idler block.

20 Claims, 7 Drawing Sheets

(56) References Cited

U.S. PATENT DOCUMENTS

| | | | | |
|---|---|---|---|---|
| 8,677,791 | B2 * | 3/2014 | Piotrowski | E05B 27/0042 70/421 |
| 9,200,474 | B1 * | 12/2015 | Chen | E05B 35/06 |
| 9,435,140 | B2 * | 9/2016 | Chen | E05B 27/00 |
| 10,337,208 | B2 * | 7/2019 | Chen | E05B 35/06 |
| 10,428,556 | B2 * | 10/2019 | Bowley | E05B 27/0007 |

* cited by examiner

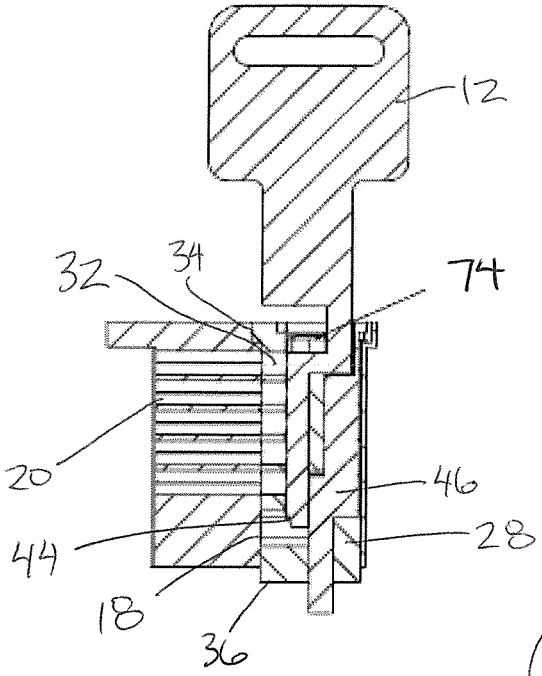
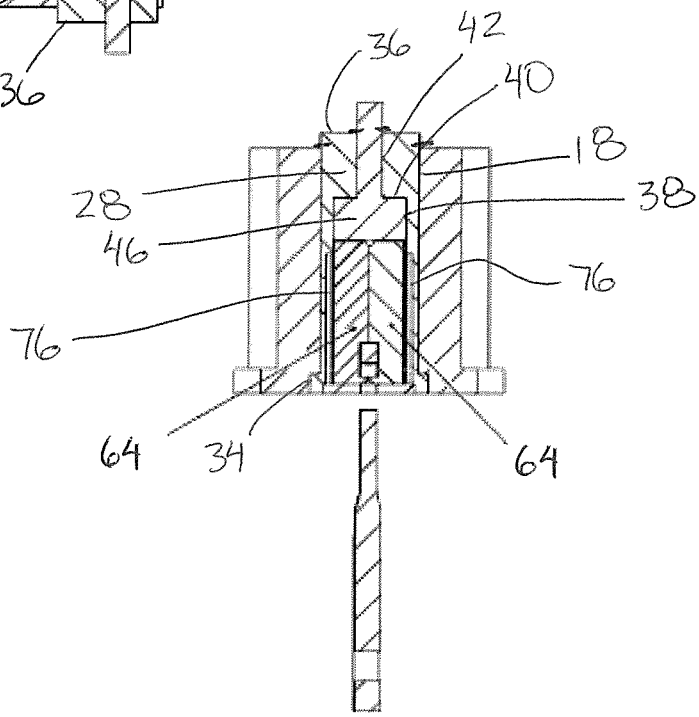
Fig. 10
Fig. 11

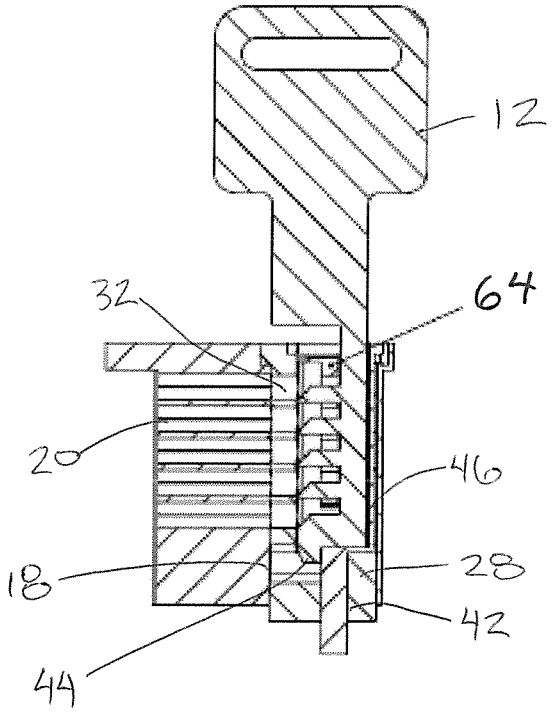
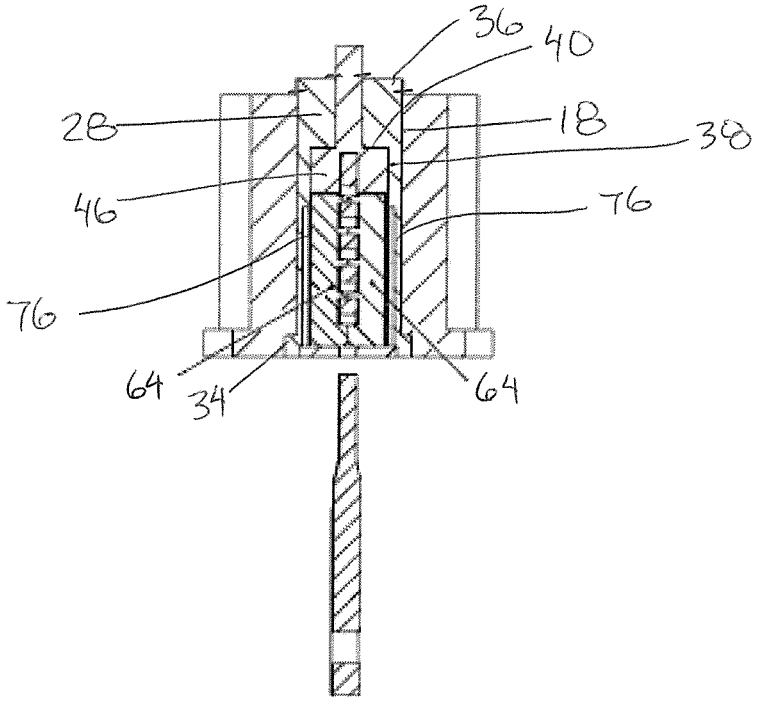
Fig. 13
Fig. 14

HIGH SECURITY LOCKING SYSTEM WHICH FORMS A DEVIATING PICKING PATH AND ASSOCIATED DEVIATED KEY

This application claims the benefit under 35 U.S.C. 119(e) of U.S. provisional application Ser. No. 62/746,643, filed Oct. 17, 2018.

FIELD OF THE INVENTION

The present invention relates to security locks and deviated keys for the purpose of controlling entry to doorways, padlocks, safes, automobiles and the like. More particularly, the present invention relates to a locking system with a deviating picking path incorporating one or more movable shield elements that selectively restrict access along the picking path to the elements of the locking system that are released by engagement of the key.

BACKGROUND

Currently, general security locks and keys may be susceptible to tampering and may easily be overcome. This may lead to unauthorized access to potentially sensitive areas secured by locks and keys. High security locking systems may be used to properly restrict access to controlled areas. Generally, high security or pick proof locks may include a common shaped linear key in which many surfaces of the key have features or biting which interact with tumbler pins that are on several different axes. These features often may be nonstandard shapes to make key copying difficult. Additionally, the tumbler pins or tumblers themselves may have special shapes similar to a bobbin which should make them hard to "set" or create a false set during picking efforts. This combination of features makes picking the lock difficult through making the effort much more tedious by increasing the number and complexity of the tumbler pin arrangement. However, current high security locking systems have drawbacks. For example, the manipulation of the tumbler pins and tumblers is readily accessible from the inlet of the linear key hole and often can be picked using straight picking tools.

U.S. Pat. No. 10,428,556 by Bowley Lock Company Inc. discloses one example of a locking system which generates a deviated picking path; however, the deviated picking path requires multiple components including a lock housing, a lock cylinder rotatable within the lock housing, an idler block rotatable with the lock cylinder and a stationary block within the lock cylinder which must be held stationary relative to one of the locking cylinder or the lock housing.

SUMMARY OF THE INVENTION

According to one aspect of the invention there is provided a high security locking system for use with tumbler pins, the locking system comprising:

a deviated key;

a lock housing, wherein the lock housing comprises an outer face, a housing bore extending axially inward from the outer face, and a plurality of first pin slots extending outward from the housing bore;

a lock cylinder comprising a plurality second pin slots formed in the lock cylinder arranged to at least partially receive the tumbler pins therein;

the lock cylinder being disposed within the housing bore of the lock housing such that a rotation of the lock cylinder within the housing bore of the lock housing is dependent upon a position of the tumbler pins within the second pins slots;

an idler block disposed within the lock cylinder;

the idler block including a keyway formed therein to extend inwardly from a keyhole at the outer face of the lock housing so as to be arranged to receive the deviated key inserted into the keyway;

the idler block being rotatable with the deviated key relative to the lock cylinder from an entry position allowing insertion of the deviated key into the keyway and a pin position aligning the deviated key with one or more of the second pin slots in the lock cylinder; and at least one translating shield disposed within the idler block so as to be slidably movable relative to idler block between an open position in which the keyway and the keyhole are substantially unobstructed by the at least one translating shield to allow for insertion and removal of the deviated key relative to the keyway and a closed position in which the at least one translating shield protrudes at least partway into a path of at least one of the keyway and the keyhole without interfering with rotation of the deviated key with the idler block from the entry position to the pin position.

According to a second aspect of the present invention there is provided a method of operating a high security locking system comprising:

providing a high security locking system comprising (i) a deviated key, (ii) a lock housing having first pin slots, (iii) a lock cylinder having second pin slots and being disposed within lock housing such that a rotation of the lock cylinder relative to the lock housing is dependent upon a position of tumbler pins received within the pin slots, (iv) an idler block defining a keyway to receive the deviated key therein in which the idler block is rotatable relative to the lock cylinder between an entry position and a pin position aligning the deviated key with one or more of the second pin slots in the lock cylinder, and (iv) at least one translating shield disposed within the idler block for translating movement;

inserting the deviated key into the keyway in the entry position of the idler block;

rotating the idler block with the deviated key from the entry position to the pin position; and displacing said at least one translating shield relative to the idler block as the idler block is displaced from the entry position to the pin position from an open position of the translating shield in which the keyway is substantially unobstructed by the translating shield to allow for insertion and removal of the deviated key relative to the keyway and a closed position in which the translating shield protrudes at least partway into a path of the keyway and the keyhole without interfering with rotation of the deviated key with the idler block from the entry position to the pin position.

The disclosed embodiments recite a high security locking system, where the lock and deviated key may form a deviated path. Advantageously, the deviated path may restrict the ability of any tampering equipment from entering the high security locking system by creating a deviated pick path in order to access the tumbler pins. This may be accomplished by using a rotating idler block and/or a plurality of rotating idler blocks that when rotated relative the lock cylinder cause shields or wards to enter the idlers keyway and break the initial entry slot of the keyhole into a deviated path of changing direction. This deviated path may restrict access to the tumbler pins from outside of the high security locking system unless rotated with the idler block.

Generally, a deviated key may be inserted into the high security locking system but may not engage the locking assembly. As used herein, the term "deviated key" refers to a deviated key having a shaft defining a deviated key axis of rotation and a pin engagement portion which is radially offset from the deviated key axis of rotation and/or separated from the shaft by an axial slot. The deviated key may comprise a number of different shapes, including, but not limited to, an axial fork shaped deviated key, reverse axial fork shaped deviated key, radial forked shaped deviated key, and/or any combinations thereof. In embodiments, the deviated key may be able to freely rotate within the high security locking system. The high security locking system may contain an idler block which may rotate with the deviated key. This rotation of the deviated key within an idler block may produce a path for the deviated key to access a set of tumbler pins. In general, the tumbler pins may be located at angle away from the initial deviated key entry angle. This may require the idler block inside to be turned by the deviated key to expose the tumbler pins to the deviated key. The idler block may hold the tumbler pins in a locked position and may further physically cover the tumbler pins, preventing access to the tumbler pins. Upon rotation within the high security locking system, the deviated key may be trapped within the high security locking system. Rotation of the deviated key back in line with the initial entry angle may allow for the deviated key to be removed. Once the deviated key is in position of the tumbler pins, the tumbler pins may interact with the deviated key to free a lock cylinder, which may be rotated to open or close the lock. In embodiments, the deviated key may be pushed further in or out, engaging the lock cylinder which may provide torque to operate the high security locking system.

Generally, an attempt to pick the high security locking system may require special shaped tools. These tools may have difficulty accessing the tumbler pins due to the stationary block. The amount of tools that may be necessary to successfully pick the high security locking system may prevent each tool from functioning properly. Additionally, general locks may be broken into by drilling out the cylinder, rendering the locking mechanism useless. In embodiments, the high security locking system may comprise a face and a lock housing which may include hardened objects, preventing the ability to drill out the high security locking system. For example, small cylinders of tungsten carbide, hardened steel, diamond inserts, and/or the like may be pressed into multiple locations to render any machine tool useless.

The only limitation of having a stationary shield is the large size of the assembly. In order to fit in many standard lock configurations on the market today a smaller lock cylinder is necessary. This invention differs from U.S. Pat. No. 10,428,556 in that the member which breaks the keyway path is no longer stationary to the lock cylinder housing but rather is embedded in the rotating idler and is able to translate into and out of the keyway. The motion of the shield(s) is driven by the profile on the inner diameter of the lock cylinder (plug). When the rotating idler is in the 6 o'clock position the shields are able to translate out of the path of the key by moving in to a recess in the lock cylinder. The rotating idler has slots that allow the shields to translate in a mainly radial direction from the axis of the lock rotating idler. When the rotating idler is rotated to the 12 o'clock position or in some applications any position other than its starting position the shields are driven inward via contact with the wall of the lock cylinder and as such interrupt the key path making a deviated keyway. This motion essentially traps the key in the lock until it is returned to the initial entry angle where once again the shields are able to translate into the reliefs in the lock cylinder and the key can be removed.

This lock differs somewhat in components that the original patents referenced above but functions in a similar method. On main difference is that the initial rotation of the key and idler happen around an offset axis of that of the lock cylinder. They are no longer concentric. The idler still holds the pins in a lock position until the idler is rotated to uncover them. The key must still be pushed inwards to allow the pins to engage the key and the key to engage the lock cylinder to apply the torque.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

Preferably the tumbler pins are at least partially received within the second pin slots in the lock cylinder such that the tumbler pins are moveable from a first position to a second position, wherein a shear plane between the lock housing and the lock cylinder is not blocked in the second position to enable the relative rotation of the lock housing and the lock cylinder.

The deviated key may be an axial fork key, a reverse axial fork key, or a radial fork key according to the illustrated embodiments. Preferably the deviated key comprises a shaft that has an offset axis of rotation, and an offset arm that is radially offset from deviated key axis of rotation, in which the offset arm comprises a base plane and at least one pin engagement and wherein the base plane is a single level across the offset arm.

Each translating shield is preferably movable between the open position and the closed position thereof linearly relative to the idler block and transversely to an axis of rotation of the idler block.

Each translating shield may be supported for sliding movement between the open and closed positions within a respective slot within the idler block.

When there are two translating shields, each translating shield is preferably arranged to extend at least partway into said path of at least one of the keyway and the keyhole in the closed position. In this instance, the two translating shields may be spaced apart at laterally opposing sides of the keyway and keyslot in the open position and abut one another in the closed position.

Each translating shield may protrude at least partway into the path of the keyway and/or the keyway in the closed position. The keyhole in the illustrated embodiment is formed in an outer face of the idler block.

Each translating shield may include a first portion which protrudes at least partway into the path of the keyway in the closed position and a second portion oriented transversely to the first portion which covers at least part of the keyhole.

Each translating shield may be displaced from the open position to the closed position in response to the idler block being rotated from the entry position towards the pin position.

Each translating shield may have a cam portion arranged to follow a cam profile defined on an inner surface of the lock cylinder to displace the translating shield from the open position to the closed position.

When the idler block defines an outer boundary that is cylindrical in shape, each translating shield is preferably movable between the open position in which the translating shield protrudes outwardly beyond the outer boundary of the idler block and the closed position in which the translating shield is fully contained within the outer boundary of the idler block.

When the lock cylinder receives the idler block within a cylinder bore having a cylindrical inner surface, each translating shield is preferably received within a respective groove formed in the cylindrical inner surface of the cylinder bore in the open position.

When the lock cylinder is rotatable relative to the lock housing about a cylinder axis and the idler block is rotatable relative to the lock cylinder about an idler axis, the idler axis may be parallel and spaced apart from the cylinder axis.

According to another aspect of the present invention there is provided a locking system comprising:

(i) a key;

(ii) a lock housing;

(iii) a lock member disposed within the lock housing so as to be selectively movable relative to the lock housing into an unlocked position upon engagement by the key;

(iv) a keyway receiving the key therein; and (v) at least one shield being movable at least partway into the keyway in response to the key engaging the lock member to release the lock member into the unlocked position.

In this instance, the locking system may use tumbler pins engaged by the key to fix or release the lock member relative to the lock housing, for example by providing pin slots in the lock housing and the lock member that receive the tumbler pins. In a further embodiment, disk detainers or slider elements may be incorporated into the locking system to provide the function of the lock member being either fixed and locked or released and unlocked relative to the lock housing.

According to a further aspect of the present invention there is provided a high security locking system for use with tumbler pins, the locking system comprising:

(i) a key;

(ii) a lock housing including a plurality of first pin slots;

(iii) a lock cylinder disposed within the lock housing including a plurality second pin slots such that a rotation of the lock cylinder within the housing bore of the lock housing is dependent upon a position of the tumbler pins within the first and second pins slots;

(iv) an idler block forming a keyway receiving the key therein, the idler block being rotatable with the key relative to the lock cylinder; and (v) at least one shield disposed within the idler block and being movable at least partway into the keyway in response to the key being rotated to align the key with the pin slots and engage the tumbler pins.

BRIEF DESCRIPTION OF THE DRAWINGS

Some embodiments of the invention will now be described in conjunction with the accompanying drawings.

FIGS. 10 and 11 show the shields and how they disrupt the initial keyway into a deviated path in the shape of the forward forked key.

FIGS. 13 and 14 show the shields and how they disrupt the initial keyway into a deviated path in the shape of the transverse forked key.

In the drawings like characters of reference indicate corresponding parts in the different figures.

DETAILED DESCRIPTION

Figure 1:
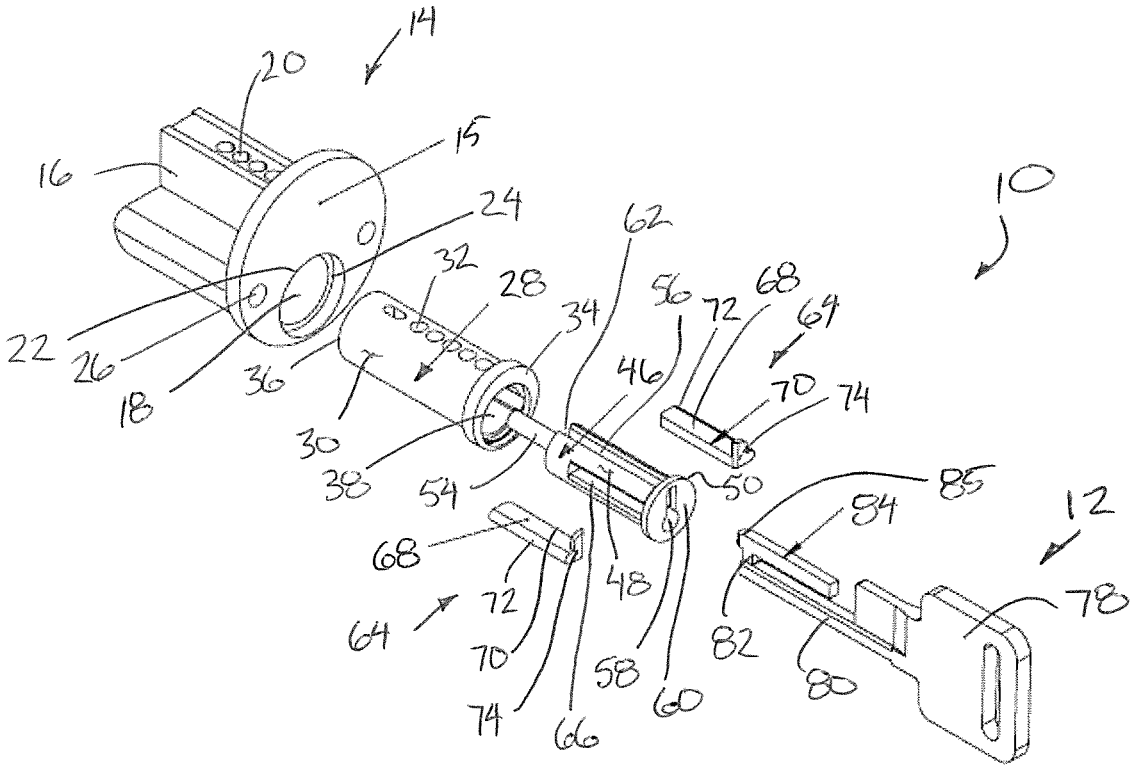
FIG. 1 shows a preferred embodiment of the lock design. The lock cylinder housing houses the pins (not shown) and a lock cylinder. The lock cylinder houses the rotating idler. The Inner diameter of the lock cylinder has a cam like shape which allows the shields to be driven into and out of the keyway path of the idler. The rotating idler has slots cut in it to allow the motion of the shields.
Figure 2:
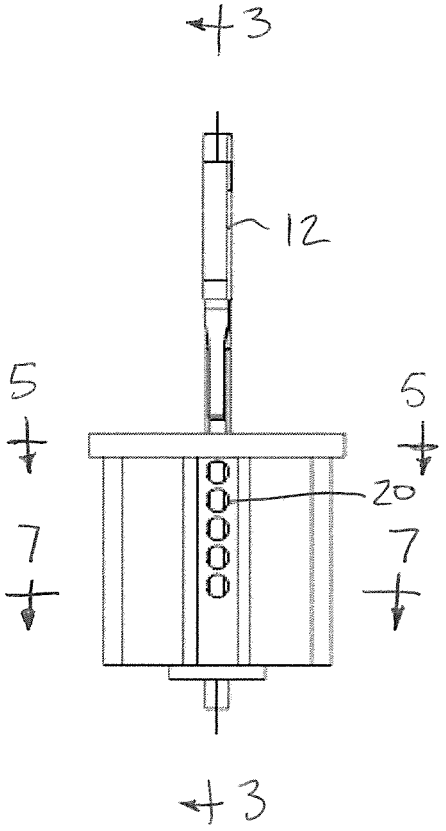
FIG. 2 is a top plan view of the assembled lock system.
Figure 3:
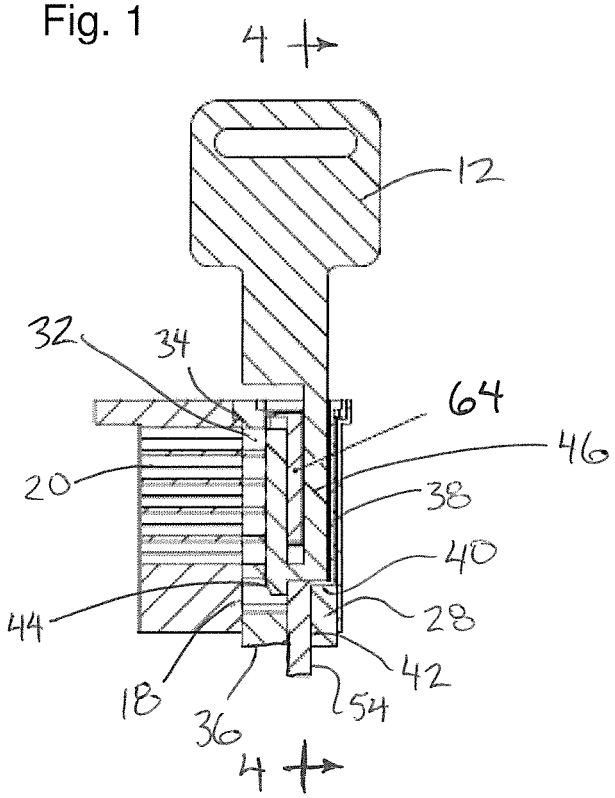
FIG. 3 shows a cross section view of the key in the 12 o'clock position and points out the location of the shield as it engages the keys slot.

Referring to the accompanying figures, there is illustrated a high security locking system generally indicated by reference numeral 10. The high security locking system generally comprises a pin tumbler type lock that using tumbler pins (not shown) that are operated within the locking system using a deviated key 12 between locked and unlocked conditions of the locking system.

Although there are numerous embodiments illustrated in the accompanying figures, the features in common with the various embodiments will first be described herein.

The locking system 10 includes a lock housing 14 having a face plate 15 defining an outer face at the exterior of the housing and an inner body 16 extending axially inward from the outer face. The inner body 16 surrounds a housing bore 18 which is generally cylindrical in shape and which defines a lock cylinder axis. The inner body also forms a plurality of first pin slots 20 therein in the form of cylindrical bores which extend radially outward from the housing bore 18 at axially spaced apart positions from one another within a single row lying generally in a common plane according to the illustrated embodiment. The first pin slots 20 are arranged to at least partially receive tumbler pins therein for operation of the lock system.

The face plate 15 locates an outer opening 22 therein which is in alignment with the housing bore 18. A perimeter edge 24 about the outer opening 22 is stepped in profile so is to define an inner portion having a first diameter and an outer portion which is increased in diameter relative to the inner portion to define a shoulder therebetween. The inner portion has an inner diameter which is equal to and aligned with the inner diameter of the cylindrical inner surface of the housing bore 18.

The face plate 15 protrudes radially outward beyond the remainder of the inner body 16 to define a support flange about the outer perimeter of the face plate which is suitable for mounting against a supporting surface receiving the lock system therein. Mounting apertures 26 may be provided in the face plate and/or the inner body to receive suitable fasteners therethrough for fastening the face plate against the supporting surface receiving the locking system therein.

A lock cylinder 28 is received within the housing bore 18 by insertion of the lock cylinder through the exterior opening 22 in the face plate of the lock housing. The lock cylinder 28 has an outer surface defining a generally cylindrical boundary of the lock cylinder having an outer diameter which is approximately equal to the inner diameter of the housing bore 18 so as to support the lock cylinder therein for rotation about the lock cylinder axis defined by the housing bore 18. The lock cylinder 28 includes second pin slots 32 therein as described in further detail below which at least partially receive the tumbler pins therein during operation of the lock system such that rotatability of the lock cylinder 28 within the lock housing is dependent upon a condition of the tumbler pins within the pin slots.

The lock cylinder includes a face flange 34 extending radially outward from the cylindrical outer surface 30 at the outer end of the lock cylinder in which the outer diameter of the face flange 34 corresponds to the outer diameter of the outer portion of the perimeter edge 24 of the outer opening in the lock housing. In this manner the face flange 34 which extends radially outward from the cylindrical outer surface is arranged to fit within the outer portion of the exterior opening 22 to be flush at the outer end thereof with the outer face of the face plate 15. The remainder of the lock cylinder 28 extends fully through the lock housing to an opposing inner end 36 which protrudes axially beyond the inner end of the lock housing 14. A suitable snap ring or other comparable retention structure can be supported on the inner end of the lock cylinder to retain the lock cylinder mounted within the lock housing.

The lock cylinder 28 locates a cylinder bore 38 therein having an inner surface which is generally cylindrical about a respective idler axis which is parallel to but spaced from the cylinder axis defined by the housing bore 18. In this instance the cylinder bore 38 is not concentric with the housing bore 18. The cylinder bore 38 is open at the exterior or outer end of the lock cylinder and extends axially inward only partway through the lock cylinder 28 to an opposing terminal inner end 40 of the cylinder bore. A centre bore 42 which is concentrically aligned with the cylinder bore extends fully through the lock cylinder from the terminal inner end 40 of the cylinder bore 38 to the inner end of the lock cylinder. The terminal inner end 40 of the cylinder bore 38 further includes a notch 44 formed therein protruding axially into the body of the lock cylinder from the cylinder bore 38 at a location offset from the idler axis in a first radial direction from the idler axis.

The second pin slots extend through the body of the lock cylinder 28 in a radially outward direction from the cylinder bore in the first radial direction corresponding to the direction of offset of the notch 44 from the idler axis. The second pin slots are axially spaced apart from one another to lie in a generally common plane such that each second pin slot aligns with a respective one of the first pin slots in a locked condition of the lock cylinder 28 relative to the lock housing.

Dependent upon the condition of the tumbler pins received within the pin slots, the lock cylinder 28 is rotatable relative to the lock housing from the locked position, to an unlocked position for releasing an associated locking mechanism in the usual manner of a locking system with a lock cylinder that is selectively rotatable relative to a lock housing using tumbler pins.

The tumbler pins are received within the pin slots so as to be slidable between a locked condition in which some of the lock pins span across a shear plane defined at the transition between the first pin slots in the lock housing and the second pin slots in the lock cylinder to block rotation of the lock cylinder relative to the lock housing, and an unlocked condition in which the shear plane between the lock housing and the lock cylinder is not blocked to enable the relative rotation between the lock housing and the lock cylinder.

The lock system further includes an idler block 46 which is received within the cylinder bore 38 for rotation relative to the lock cylinder 28 about the idler axis defined by the cylinder bore 38. The idler block 46 includes an outer surface 48 defining a generally cylindrical outer boundary having an outer diameter approximately equal to the inner diameter of the cylinder bore to support the idler block rotatably therein. The idler block is inserted through the open end of the cylinder bore at the exterior or outer end of the lock system. A face flange 50 is formed at the outer end of the idler block which protrudes radially outward beyond the cylindrical outer surface 48 to be received within a corresponding counterbore 52 formed at the outer end of the cylinder bore 38 such that the outer end of the idler block is substantially flush with the exterior faces of the lock cylinder 28 and the lock housing 14 according to the illustrated embodiment.

The body of the idler block defining the cylindrical outer surface 48 extends substantially the full length of the cylinder bore from the outer open end to the terminal inner end thereof. The idler block further includes a centre shaft 54 protruding axially beyond the inner end of the idler block to protrude beyond the inner end of the lock cylinder and the lock housing through the centre bore 42 in the lock cylinder. A suitable snap ring or other retention structure can be mounted at the inner end of the centre shaft to retain the idler block 46 mounted within the lock cylinder 28.

The idler block 46 defines a keyway 56 therein in the form of a suitable slot or channel having a cross-sectional shape corresponding to the deviated key 12 to receive the key axially slidable therein. The keyway 56 extends axially substantially the full length of the idler block from an open and defining a keyhole 58 within the outer face 60 at the outer end of the idler block 46 which corresponds to the location of the outer face of the lock housing at the exterior of the lock system.

The channel defining the keyway 56 extends axially inward from the keyhole to an opposing inner end located in close proximity to the inner end of the idler block. Part of the keyway is closed by an inner end wall at the location of the centre shaft 54. The keyway 56 extends radially outward to be open radially along the full length of the channel to a first side of the idler block while the channel remains closed at the diametrically opposing side of the idler block.

At the inner end of the keyway 56, a notch opening 62 communicates axially from the keyway fully through to the inner end of the idler block at an offset location from the axis towards the first side of the idler block. The notch opening 62 is arranged to be aligned with the notch 44 at the inner end of the cylinder bore in a pin position of the idler block in which the open side of the keyway 56 at the first side of the block is aligned with the pin slots in the lock cylinder so that a key received within the keyway channel can cooperate with the tumbler pins in the pin slots to release the lock.

Figure 4:
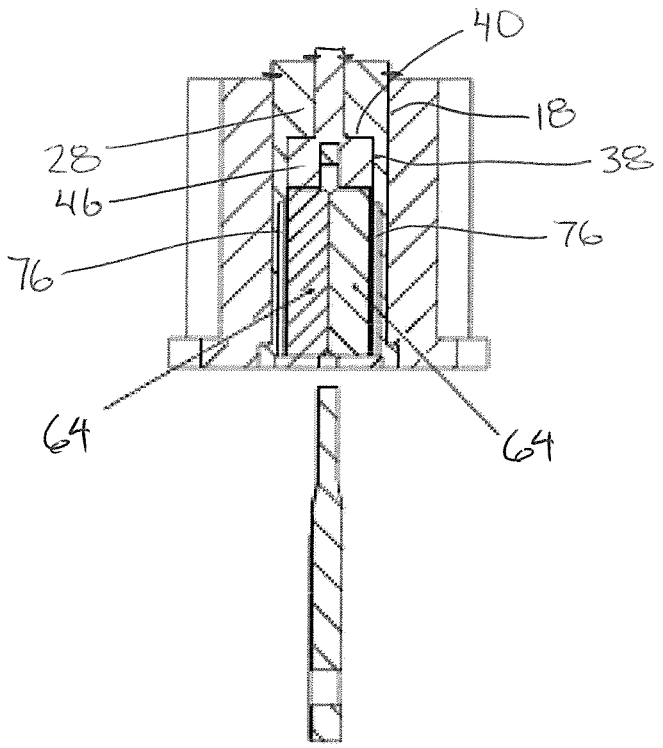
FIG. 4 shows the shields from a cross section view from the top direction. It shows how the shields have closed inward and have filled the slot of the key accomplishing the same task as the stationary block of U.S. Pat. No. 10,428,556.
Figure 5:
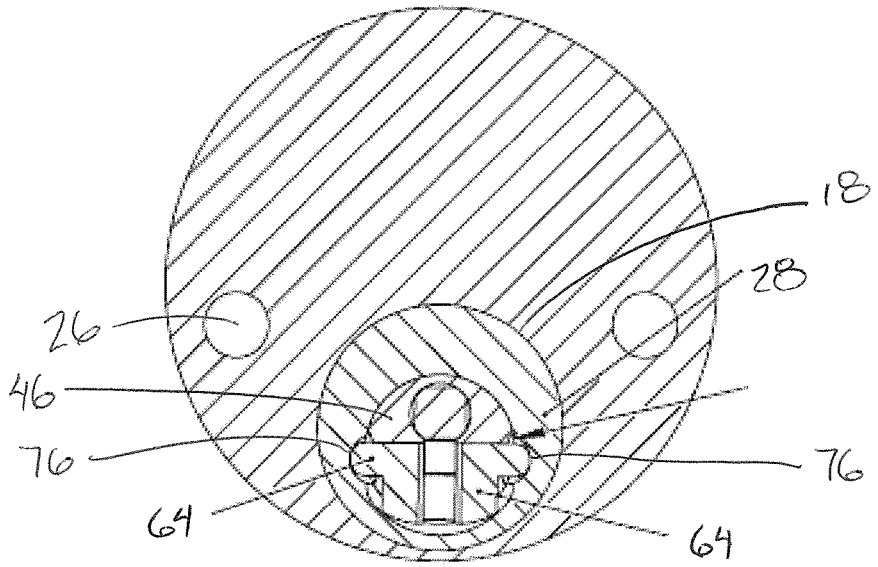
FIG. 5 shows the cam path of the lock cylinder plug. The rotating idler is shown in the 6 o'clock position and the shields can be shown as recessing into the reliefs in the cam profile. This allows the shields to retract out of the way of the key slot.
Figure 6:
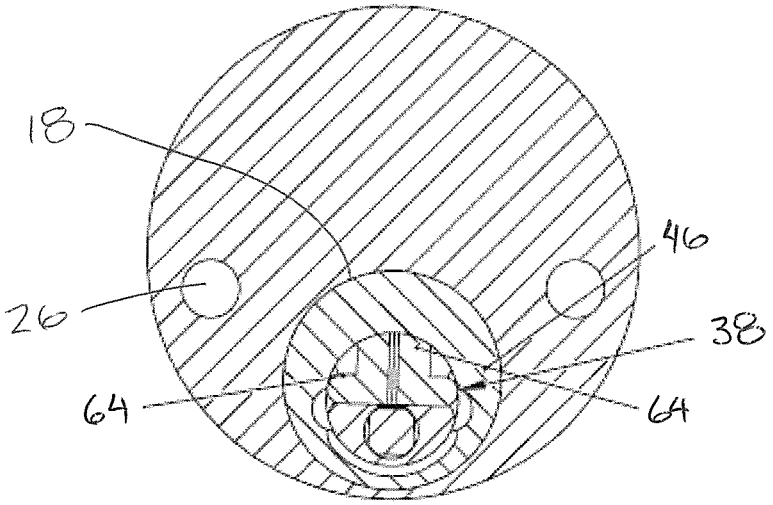
FIG. 6 is the same view as FIG. 5, but with the rotating idler rotated in this embodiment 180° to the 12 o'clock position. It can be seen that the shields have not been forced closed due to the action of the cam profile on the inside diameter of the lock cylinder plug. It should be noted that the cam and cam followers are circular in these figures but are not bound in anyway by that simple shape. This may be preferred due to ease of fabrication but not necessarily the case.
Figure 7:
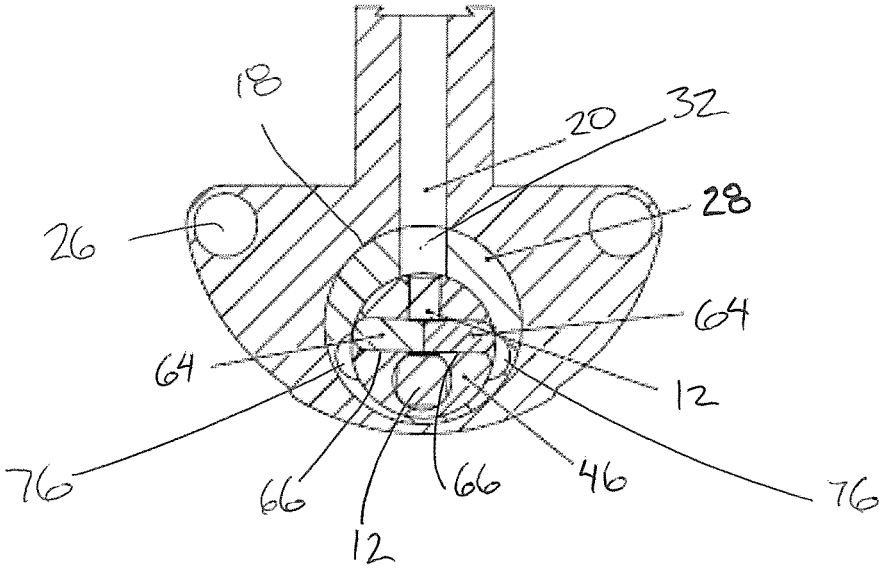
FIG. 7 is the same embodiment but with the cross sections taken further into the lock to show the shield penetrating the key. The shields are closed. The idler block has exposed the pins to the top surface of the key. The pin holes are housing the pins (not shown). The lock cylinder plug is now able to be rotated and actuate the lock mechanism (not shown).

The idler block is rotatable from the pin position according to FIGS. 6 and 7 for example, to an entry position according to FIGS. 1, 4 and 5 for example. In the entry position, the idler block is arranged to accept insertion and removal of the deviated key as described in further detail below. Rotation of the idler block with the key through 180° will displace the idler block from the entry position to the pin position for alignment with the pin slots to cooperate with the tumbler pins to release the lock.

The lock system further includes two translating shields 64 which are supported in respective shield slots 66 within the idler block such that the translating shields are linearly slidable in a radial direction relative to the idler block between an open position in which the keyway and the keyhole are substantially unobstructed by the translating shields to allow for insertion and removal of the deviated key relative to the keyway and a closed position in which the translating shields each protrude at least partway into the path of the keyway and keyhole in a manner that does not interfere with rotation of the deviated key with the idler block from the entry position to the pin position.

The two shield slots 66 receiving the translating shields 64 respectively therein extend radially outward from the keyway to the cylindrical outer surface of the idler block at diametrically opposing sides of the keyway such that each slot is open at an inner end to the keyway slot and is open at the outer end thereof to the cylindrical outer surface of the idler block. Each slot also extends axially most of the length of the idler block from the face plate towards the inner end of the idler block. The open outer end of each shield slot at the cylindrical outer surface of the idler block is offset angularly from the opening of the keyway 56 at the first side of the block by approximately 90° such that the open outer ends of the two shield slots are approximately 180° apart from one another and such that the shield slots extend outward from the keyway channel 56 in laterally opposing directions to lie in a generally common plane with one another.

Each shield 64 includes a main body portion 68 substantially fully occupying the shield slots 66 to span axially a majority of the length of the keyway. The main body portion 68 extends radially outward from an inner edge 70 arranged to selectively protrude partway into the path of the keyway to an outer edge 72 arranged to selectively protrude beyond an outer boundary defined by the cylindrical outer surface of the idler block through the open outer end of the respective slot. The outer edge has a rounded profile which is curved about a respective longitudinal axis oriented parallel to the idler axis to have a convex exterior shape.

Each shield 64 also includes a face portion 74 in the form of a flat plate oriented generally perpendicular to the axial length and which is mounted at one end of the main body portion 68 corresponding to the outer end of the locking system such that the face portion 74 is adjacent to the keyhole for selectively spanning across and covering the keyhole in the closed position of the shields. Each shield slot 66 includes an enlarged opening at the inner end thereof to slidably receive the face portion 74 of the corresponding translating shields therein.

In the open position of the shields, in which the outer edges 72 of the shields protrude outwardly beyond the cylindrical boundary of the idler block at laterally opposing sides thereof, the outer edges of the shields are received within respective longitudinal grooves 76 which are formed in the cylindrical inner surface of the cylinder bore within the lock cylinder. Each longitudinal grooves 76 extends axially substantially the full length of the idler block for alignment with the outer edges of the shields in the entry position of the idler block relative to the lock cylinder. Each longitudinal groove 76 is curved about a longitudinal axis oriented parallel to the idler axis to define a concave surface. The radius of curvature of each groove is much greater than the radius of curvature of the outer edges of the shields to define a cam profile which urges the respective shield inward from the open position to the closed position thereof as the idler block is rotated in either direction away from the entry position towards the pin position.

The translating shields are automatically displaced laterally inwardly towards one another from the open position towards the closed position due to the interaction of the outer edges of the shields with the cam surface profile of the longitudinal grooves 76 as the idler block is rotated relative to the lock cylinder away from the entry position towards the pin position. When the shields are in the open position, the outer edges of the shields protrude into the corresponding grooves 76 in the lock cylinder to retain the idler block in the entry position as long as the shields are held open. Accordingly, the idler block is prevented from being rotated to the pin position for access to the pin slots if picking tools are inserted into the keyway which prevent closing of the shields.

The deviated key 12 in each instance includes a handle grip 78 arranged to be gripped between fingers of the user for insertion of the key into the lock system and for rotating the key about a respective longitudinal axis of the key. Each embodiment of the key further includes a main shaft 80 extending from the handle grip in the direction of the longitudinal axis of the key. One or more offset arms 82 extends radially from the main shaft 80 to support a pin engagement portion 84 thereon which is supported on the one or more offset arms 82 to be radially offset from the main shaft 80.

The pin engagement portion 84 defines a base plane parallel to the longitudinal axis defined by the main shaft in which the base plane is a single level across the offset arm. A pin engagement formation is formed on the pin engagement portion in association with each pin slot in which a radial distance of the pin engagement formations from the base plane may vary from one another.

A protuberance 85 is provided in alignment with the pin engagement portion 84 to protrude beyond the remaining elements of the key in the axial direction opposite from the handle grip 78. The protuberance 85 is arranged for communicating through the notch opening 62 at the end of the idler block for being received within the notch 44 at the terminal end of the lock cylinder bore in the pin position of the idler block by axially displacing the key further into the keyway once the idler block is in the pin position. The engagement of the protuberance within the notch 44 engages the key with the lock cylinder such that the key and the lock cylinder are rotatable together. Axially displacing the key to engage the protuberance within the notch also ensures that the pin engagement portions of the key are properly aligned with the tumbler pins to ensure that none of the tumbler pins cross the shear plane between the first and second pin slots for unlocking the lock cylinder relative to the lock housing.

Turning now to the first embodiment according to FIG. 1, the key in this instance comprises a reverse axial fork type key in which the main shaft 80 spans the full length of the key beyond the handle grip 78 and a single offset arm 82 is provided at the end of the key opposite from the handle grip 78. The pin engagement portion 84 is connected to the offset arm to extend axially from the distal end of the main shaft towards the proximal end of the main shaft connected to the handle grip 78 to define a radial gap between the main shaft and the pin engagement portion 84. Formations along the pin engagement portion opposite the main shaft engage the pins for release in the lock.

In this instance, the inner edge of each shield is uninterrupted along the length thereof from the inner edge of the face portion 74 to the opposing inner end of the shield. The inner edges of the face portions 74 of the shields lie in a common plane with respective ones of the inner edges 70 of the main body portion.

Figure 9:
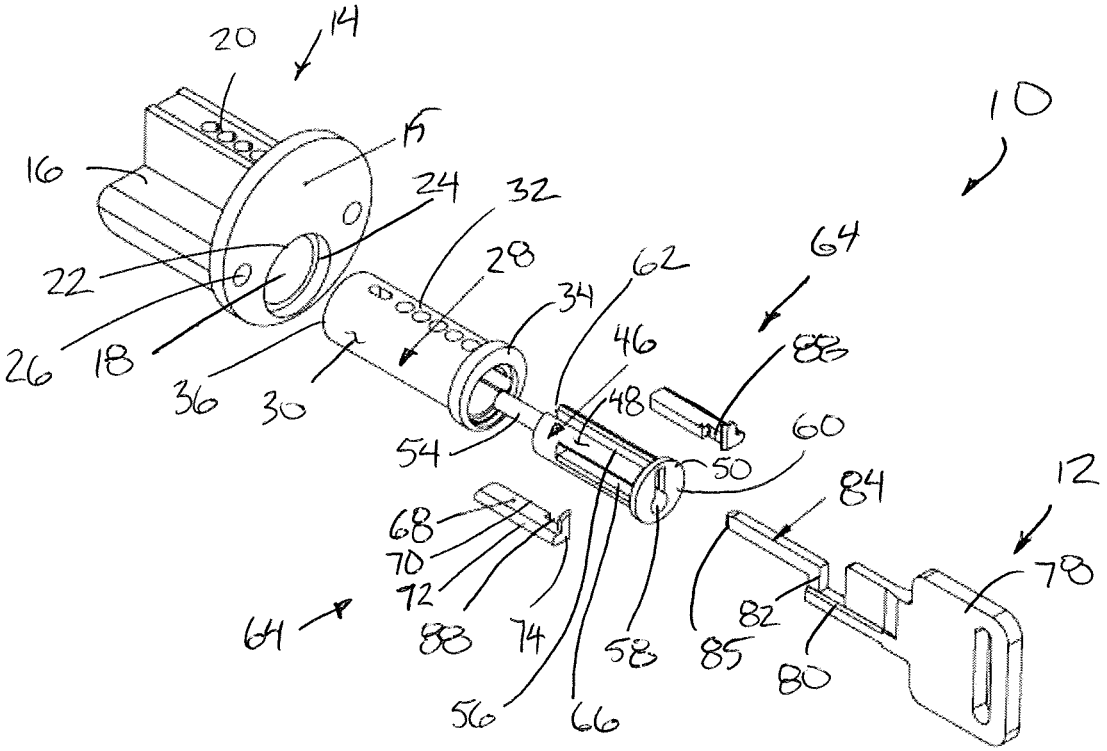
FIG. 9 shows a similar embodiment modified for a forward fork key rather than a reverse for key. In this case the shields have slightly modified reliefs to allow the shields to not interfere with the forward forked key. The deviated path is similar to the shape of the key.

Turning now to the second embodiment according to FIG. 9, the key in this instance comprises an axial fork in which the main shaft again defines the long axis of the key; however, the offset arm extends from the main shaft in close proximity to the handle grip 78 with a small axial gap therebetween. The gap corresponds to an axial thickness of the face plate and the face portions of the shields which selective cover the keyhole opening in the face plate. The pin engagement portion 84 extends axially from the offset arm away from the handle grip 78 along an axis which is parallel and spaced apart from the axis of the main shaft 80 by the radial distance of the offset arm 82. The pin engagement portion comprises a plurality of formations formed along the outer surface thereof for alignment with corresponding tumbler pins.

In this instance, the inner edge of each shield includes a notch 88 between the face portion 74 and the main body portion 68 thereof defining a gap in the axial direction. The combined cross-sectional area of both notches of the two shields combined is fully occupied by the offset arm 82 such that the shields in the closed position fully block the path of the keyway not occupied by the offset arm in the closed position thereof.

Figure 12:
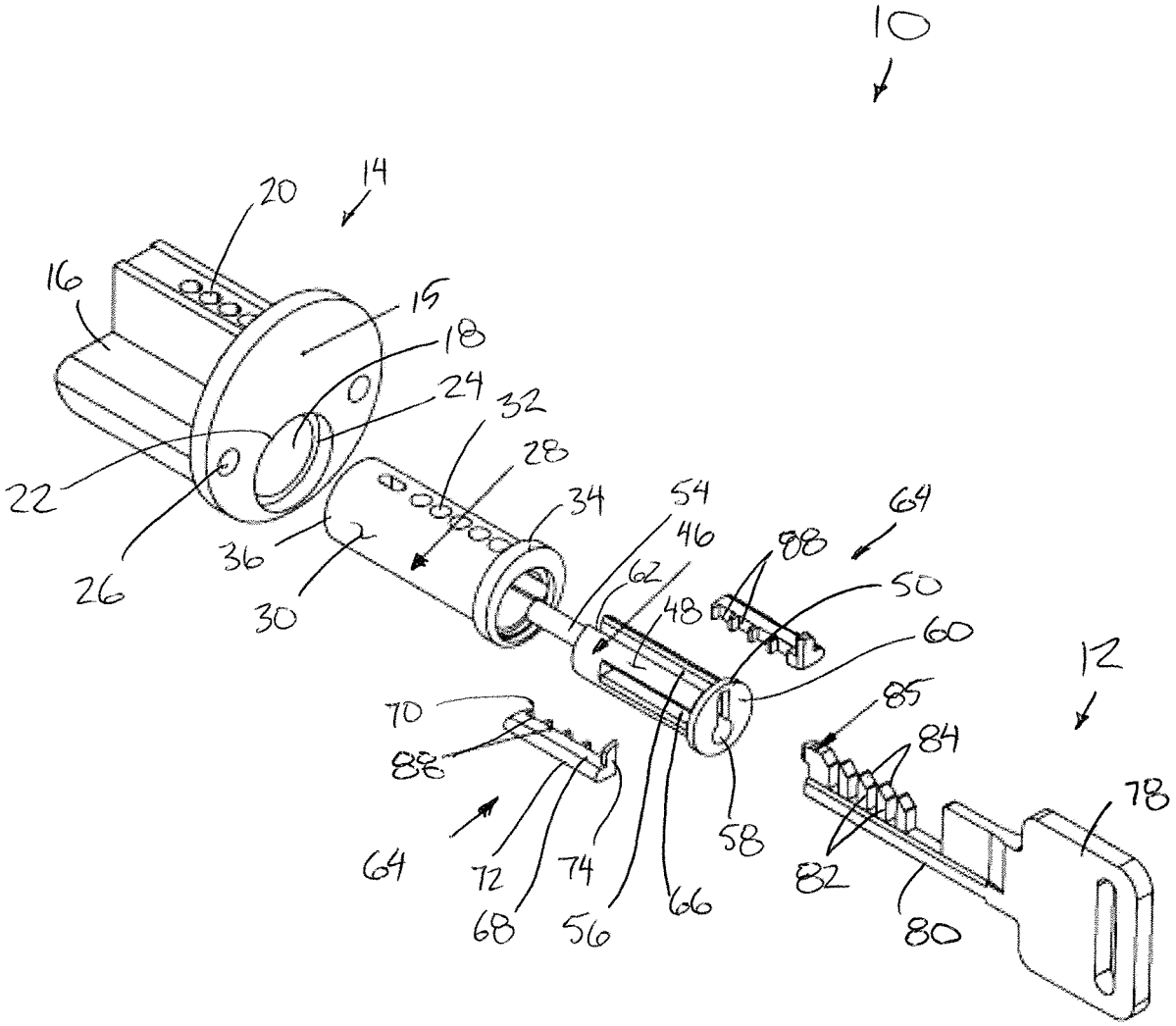
FIG. 12 shows a similar embodiment modified for a transverse fork key rather than a reverse or forward forked key. In this case the shields have slightly modified reliefs to allow the shields to not interfere with the transverse forked key. The deviated path is similar to the shape of the key.

Turning out to the embodiment according to FIG. 12, the key in this instance comprises a radial fork key in which the main shaft 80 extends the full length of the key and supports a plurality of the offset arms 82 extending radially therefrom at axially spaced apart positions. The pin engagement portion 84 comprises the outer end portion of each offset arm in which the outer end portions have varying profiles and formations thereon for engagement with respective ones of the pins.

In this instance, the inner edge of each shield includes a plurality of notches 88 in which each notch is aligned with a respective one of the offset arms in the axial direction and is suitably sized to receive a portion of the cross-sectional shape of the respective offset arm therein. The combined cross-sectional area of each notch with a corresponding notch of the other shield is arranged to be fully occupied by the offset arm 82 associated therewith such that the two shields in the closed position fully block the path of the keyway not occupied by the offset arms in the closed position thereof.

Figure 8:
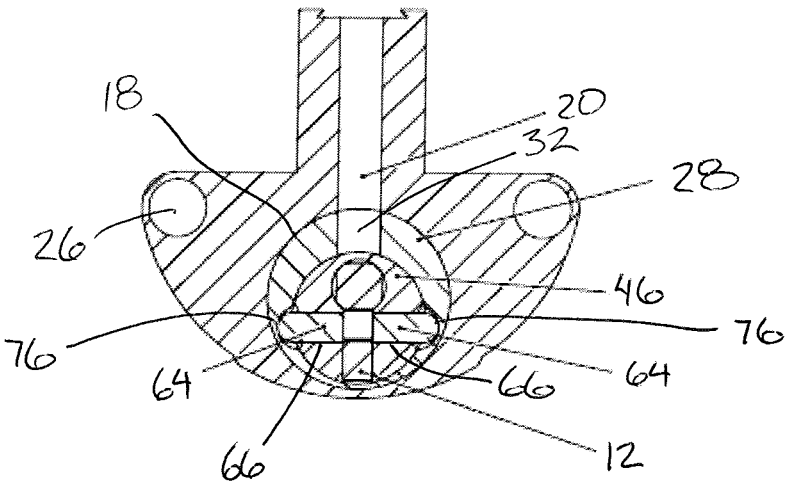
FIG. 8 shows the same view as FIG. 6 but with the idler block returned to the 6 o'clock position. It once again blocks the pins from access to the key hole. The shields have recessed back in the relief of the cam profile in the lock cylinder plug.

In an initially locked position of the locking system, the tumbler pins extend across the shear plane between the lock housing and the lock cylinder to be partly received in both the first and second pin slots. By initially positioning the idler block in the entry position according to FIGS. 5 and 8, in which the open side of the keyway channel is diametrically opposite from the location of the pin slots, the shield slots are aligned with the longitudinal grooves 76 in the lock cylinder such that the shields can be displaced laterally away from each other from the closed position to the open position and allow insertion of the key into the lock system. The keyway and the keyhole at the exterior end of the keyway are fully unobstructed in the open position of the shields.

Once the key has been inserted into the keyway, the idler block can be rotated with the key from the entry position to the pin position according to FIGS. 1, 6 and 7. Due to the cam surface profile of the grooves 76, the shields are displaced inwardly towards the closed position responsive to the rotation of the idler block relative to the lock cylinder. In the closed position of the shields, each shield extends partway into the keyway such that the main body portions 68 meet and abut one another centrally within the keyway while the face portions 74 meet centrally and abut one another within the keyhole. The face portions 74 fully block the portion of the keyhole not occupied by the main shaft of the key while the main body portions 68 fully span across the path of the keyway not occupied by the offset arms between the keyhole and the access to the pins.

Once in the pin position of the idler block, the key can be displaced axially further inward into the keyway to insert the protuberance of the key into the notch within the lock cylinder. This also acts to finally align the pin engagement portions of the key with corresponding pins to displace the tumbler pins into an unlocked condition. The key, the idler block and the lock cylinder are all fixed relative to one another by insertion of the protuberance into the notch while being rotatable relative to the lock housing together by releasing the tumbler pins into an unlocked condition. Rotation of the lock cylinder relative to the lock housing in turn releases an associated lock mechanism which is operatively connected to the lock cylinder.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A high security locking system for use with tumbler pins, the locking system comprising:

a deviated key;

a lock housing, wherein the lock housing comprises an outer face, a housing bore extending axially inward from the outer face, and a plurality of first pin slots extending outward from the housing bore;

a lock cylinder comprising a plurality second pin slots formed in the lock cylinder arranged to at least partially receive the tumbler pins therein;

the lock cylinder being disposed within the housing bore of the lock housing such that a rotation of the lock cylinder within the housing bore of the lock housing is dependent upon a position of the tumbler pins within the second pins slots;

an idler block disposed within the lock cylinder;

the idler block including a keyway formed therein to extend inwardly from a keyhole at the outer face of the lock housing so as to be arranged to receive the deviated key inserted into the keyway;

the idler block being rotatable with the deviated key relative to the lock cylinder from an entry position allowing insertion of the deviated key into the keyway and a pin position aligning the deviated key with one or more of the second pin slots in the lock cylinder; and at least one translating shield disposed within the idler block so as to be slidably movable relative to idler block between an open position in which the keyway and the keyhole are substantially unobstructed by the at least one translating shield to allow for insertion and removal of the deviated key relative to the keyway and a closed position in which the at least one translating shield protrudes at least partway into a path of at least one of the keyway and the keyhole without interfering with rotation of the deviated key with the idler block from the entry position to the pin position.

2. The high security locking system of claim 1 in combination with the tumbler pins which are at least partially received within the second pin slots in the lock cylinder, wherein the tumbler pins are moveable from a first position to a second position, wherein a shear plane between the lock housing and the lock cylinder is not blocked in the second position to enable the relative rotation of the lock housing and the lock cylinder.

3. The high security locking system of claim 1, wherein the deviated key is an axial fork key.

4. The high security locking system of claim 1, wherein the deviated key is a reverse axial fork key.

5. The high security locking system of claim 1, wherein the deviated key is a radial fork key.

6. The high security locking system of claim 1, wherein the deviated key comprises a shaft that has an offset axis of rotation, and an offset arm that is radially offset from deviated key axis of rotation, wherein the offset arm comprises a base plane and at least one pin engagement and wherein the base plane is a single level across the offset arm.

7. The high security locking system of claim 1, wherein said at least one translating shield is movable between the open position and the closed position thereof linearly relative to the idler block and transversely to an axis of rotation of the idler block.

8. The high security locking system of claim 1, wherein said at least one translating shield is supported for sliding movement between the open and closed positions within a respective slot within the idler block.

9. The high security locking system of claim 1, wherein said at least one translating shield comprises two translating shields, each translating shield being arranged to extend at least partway into said path of at least one of the keyway and the keyhole in the closed position.

10. The high security locking system of claim 9, wherein the two translating shields are spaced apart at laterally opposing sides of the keyway and keyslot in the open position and abut one another in the closed position.

11. The high security locking system of claim 1, wherein said at least one translating shield protrudes at least partway into the path of the keyway in the closed position.

12. The high security locking system of claim 1, wherein said at least one translating shield protrudes at least partway into the path of the keyhole in the closed position.

13. The high security locking system of claim 12, wherein the keyhole is formed in an outer face of the idler block.

14. The high security locking system of claim 1, wherein said at least one translating shield includes a first portion which protrudes at least partway into the path of the keyway in the closed position and a second portion oriented transversely to the first portion which covers at least part of the keyhole.

15. The high security locking system of claim 1, wherein said at least one translating shield is displaced from the open position to the closed position in response to the idler block being rotated from the entry position towards the pin position.

16. The high security locking system of claim 15, wherein said at least one translating shield has a cam portion arranged to follow a cam profile defined on an inner surface of the lock cylinder to displace the translating shield from the open position to the closed position.

17. The high security locking system of claim 15, wherein the idler block defines an outer boundary that is cylindrical in shape, said at least one translating shield being movable between the open position in which the translating shield protrudes outwardly beyond the outer boundary of the idler block and the closed position in which the translating shield is fully contained within the outer boundary of the idler block.

18. The high security locking system of claim 17, wherein the lock cylinder receives the idler block within a cylinder bore having a cylindrical inner surface, said at least one translating shield being received within a respective groove formed in the cylindrical inner surface of the cylinder bore in the open position.

19. The high security locking system of claim 1, wherein the lock cylinder is rotatable relative to the lock housing about a cylinder axis and the idler block is rotatable relative to the lock cylinder about an idler axis, the idler axis being parallel and spaced apart from the cylinder axis.

20. A method of operating a high security locking system comprising:

providing a high security locking system comprising (i) a deviated key, (ii) a lock housing having first pin slots, (iii) a lock cylinder having second pin slots and being disposed within lock housing such that a rotation of the lock cylinder relative to the lock housing is dependent upon a position of tumbler pins received within the pin slots, (iv) an idler block defining a keyway to receive the deviated key therein in which the idler block is rotatable relative to the lock cylinder between an entry position and a pin position aligning the deviated key with one or more of the second pin slots in the lock cylinder, and (iv) at least one translating shield disposed within the idler block for translating movement;

inserting the deviated key into the keyway in the entry position of the idler block;

rotating the idler block with the deviated key from the entry position to the pin position; and displacing said at least one translating shield relative to the idler block as the idler block is displaced from the entry position to the pin position from an open position of the translating shield in which the keyway is substantially unobstructed by the translating shield to allow for insertion and removal of the deviated key relative to the keyway and a closed position in which the translating shield protrudes at least partway into a path of the keyway and the keyhole without interfering with rotation of the deviated key with the idler block from the entry position to the pin position.

* * * * *